US006405557B1

(12) United States Patent
DeCastro et al.

(10) Patent No.: US 6,405,557 B1
(45) Date of Patent: Jun. 18, 2002

(54) COOLER FLOOR SUPPORT TRAY

(75) Inventors: John DeCastro; Terry Mears; Yiyun Culp; Michael Brockel; Regis Schulte, all of Wichita; Tracey Beehm, Augusta, all of KS (US)

(73) Assignee: The Coleman Company, Inc., Wichita, KS (US)

( * ) Notice: Subject to any disclaimer, the term of this patent is extended or adjusted under 35 U.S.C. 154(b) by 24 days.

(21) Appl. No.: 09/638,804

(22) Filed: Aug. 12, 2000

(51) Int. Cl.[7] ..... F25D 3/02
(52) U.S. Cl. ..... 62/459; 62/457.2
(58) Field of Search ..... 62/459, 457.2, 62/457.7, 465, 372; 248/127, 163.1, 346.01; 220/915.1, 915.2

(56) References Cited

U.S. PATENT DOCUMENTS 2,663,157 A * 12/1953 Laramy
3,494,502 A * 2/1970 Roush et al.
3,727,791 A * 4/1973 Fraser et al.
3,917,108 A * 11/1975 Thurman
4,424,687 A * 1/1984 Morgan ..... 62/457.2
5,052,184 A * 10/1991 Jarvis ..... 62/459
5,524,671 A * 6/1996 Wayman
5,655,460 A * 8/1997 Boonstra
6,126,124 A * 10/2000 Wagner ..... 248/127

* cited by examiner

*Primary Examiner*—Denise L. Esquivel
*Assistant Examiner*—Chen-Wen Jiang

(57) ABSTRACT

A support tray includes a top surface, an underside, and a side perimeter. The top surface is substantially planar and has a plurality of perforations leading to the underside. The underside includes a support grate. The support grate includes a plurality of interconnected support beams and support walls that surround the perforations. The side perimeter includes an upper rim and a lower rim and is contoured to provide for handles. Optionally, the top surface has handle straps and at least one beverage container holder that stores a beverage container in an upright or lateral position. The support tray may be made of a rigid plastic construction suitable for cleaning in a dishwasher.

19 Claims, 7 Drawing Sheets

COOLER FLOOR SUPPORT TRAY

FIELD OF THE INVENTION

The present invention relates to portable, insulated, carrying devices useful for storing, conveying and serving food and beverages, specifically to a cooler assembly for the management of a cooler's contents, and more specifically to a support tray for the isolation from liquid on a floor inside a cooler.

BACKGROUND INFORMATION

Simple, portable, hard-walled coolers formed of metal or plastic and designed solely to maintain food and beverages at low temperatures are well known in the art. For example, The Coleman Company of Wichita, Kansas, manufactures hard-sided, insulated containers, such as coolers and jugs, in a variety of shapes and sizes. The Coleman company also manufactures a LB variety of lightweight, soft-sided coolers that serve similar functions.

Coolers generally carry, for example, three categories of contents: food, beverages, and coolants. In a cooler, some foods, such as sandwiches, may be need to be stored in, for example, plastic bags or containers. Other foods, such as fruits and vegetables, may not need to be contained, but may be placed directly in the cooler. Beverages almost categorically require storage in some sort of container within a cooler, unless the cooler itself (e.g., a thermos) is to be used as the beverage container. The coolant may need to be contained, as in thermal gel packs, for example, or it may not, as in ice. Variations of these three categories may exist, such as when a food or beverage is frozen and acts as a coolant to surrounding contents as it thaws.

While one purpose of storing food and beverages in a cooler is to keep them cool, another equally important and related purpose is to preserve the food and beverages during their storage. In an effort to preserve a cooler's contents, it is generally preferable that the contents leave the cooler in almost as good a condition as that in which they were when they entered the cooler. A lack of sufficient and consistent cooling, excessive movement, excessive pressure and excessive moisture are, for example, four conditions that may damage the contents of a cooler, possibly making the contents completely undesirable. In this context, pressure refers to the force of one cooler item, such as a bottle, against another, such as a sandwich.

It would therefore be desirable to have a cooler assembly that improves the management of the cooler's contents by managing the cooling, movement, pressure and/or moisture within the cooler. The contents of a cooler may sustain less degradation during storage in the cooler if the cooler assembly incorporates improved content management. Insofar the content of a cooler generally includes, for example, food, beverages, and coolants, a desirable cooler assembly would store the food, beverages, and coolants in a manner that would improve cooling, reduce movement, relieve pressure and/or isolate moisture within the cooler.

The invention of the present application relates more specifically to the isolation moisture within the cooler. Ice id is a common source of such moisture in that coolers frequently contain ice as a coolant. As the ice absorbs the heat within the cooler, the temperature of the interior of the cooler drops, but the ice melts, turning to water. Ice is commonly sold in large, non-watertight bags for purposes such as packing a cooler. It is common to pack a cooler with the ice either freely surrounding the food or remaining in the bag resting in the cooler. In either of these instances, the melting ice causes a pool of water to form in the bottom of the cooler.

If not sealed in watertight containers, food near the bottom may become soft and water-soaked as the pool of water forms around the food. Although no longer cold enough to remain ice, the water remains cold and continues to chill the inside of the cooler. While many coolers have resealable valves at the bottom to drain liquid from the cooler, drainage of water from melted ice may reduce the cooling effect attainable from a bag of ice. Therefore, it could be advantageous to retain the cold water if the food were not sitting in the water.

It would be desirable that a cooler have the ability to accommodate food packed with ice, freely dispersed or in a bag, for example, and nonetheless separate the food from the pool of water that forms in the bottom of the cooler as the ice melts. It would be desirable that a cooler further have the ability to accommodate the pool of water formed after an entire bag of ice has melted while keeping the food separate from the pool of water. Such coolers would help maintain the quality of food during conveyance to outdoor events such as beach outings, barbecues, picnics and football games, and at the same time increase the potential cooling effect of a bag of ice.

SUMMARY OF THE INVENTION

The present invention relates to portable, insulated, carrying devices useful for storing, conveying and serving food and beverages, specifically to a cooler assembly for the management of a cooler's contents, and more specifically to a support tray for the isolation of liquid on a floor inside a cooler. A support tray according to the present invention may include a top surface, an underside, and a side perimeter. The support tray may be made of a rigid plastic construction, suitable for cleaning in a dishwasher.

The top surface may be substantially planar and have a plurality of perforations leading to the underside. The underside may include a support grate. The support grate may include a plurality of interconnected support beams and support walls. The plurality of interconnected support beams and support walls may circumnavigate the perforations. The side perimeter may include an upper rim and a lower rim for additional support. The side perimeter also may be contoured to provide for handles.

The support tray may be designed to facilitate upright storage of beverage containers. Another embodiment of the present invention may provide at least one beverage container in holder that stores a beverage container in an upright position. The base of the beverage container may rest in the cold water for improved thermal conduction during storage in the beverage container holder. A beverage container holder cap may be secured to the top surface around the beverage container holder when the beverage container holder is not in use. Likewise, a beverage container holder may store a beverage container in a lateral position.

Other features and advantages of the present invention will be apparent from the following description of the exemplary embodiments thereof, and from the claims.

DETAILED DESCRIPTION

Figure 1:
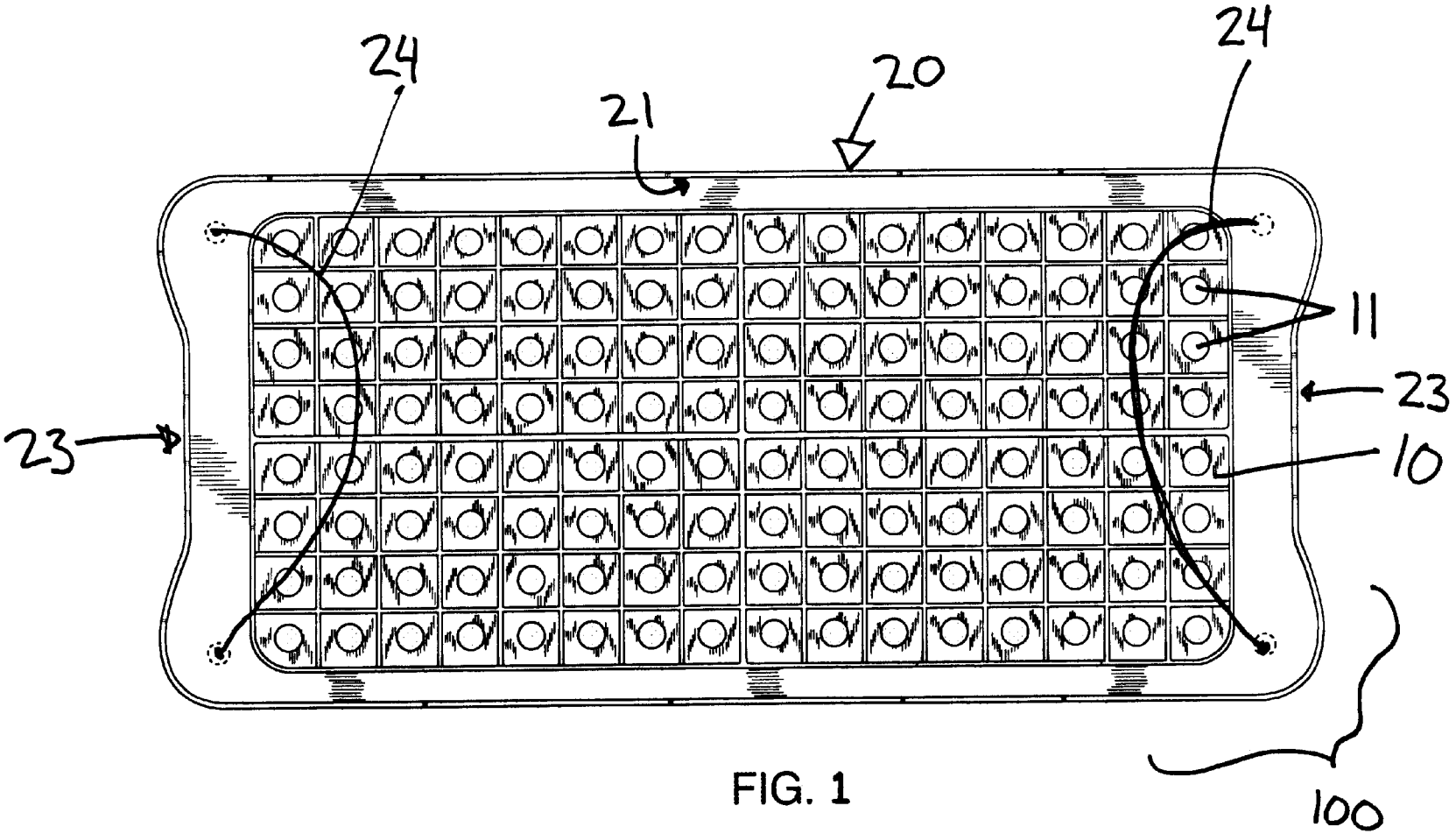
FIG. 1 is a top view of an exemplary support tray according to an embodiment of the present invention.

Beginning with FIG. 1, a top view of an exemplary support tray 100 is shown according to an embodiment of the present invention. A support tray 100 according to the present invention may include a top surface 10, a side perimeter 20, and an underside 30 (shown in FIG. 3). As shown in FIG. 1, support tray 100 includes top surface 10 that may be substantially planar and may have a plurality of perforations 11 leading to the underside 30. The support tray 100 may be made, for example, of a rigid plastic by a conventional construction, such as injection molding, suitable for cleaning in a dishwasher.

Figure 2A:
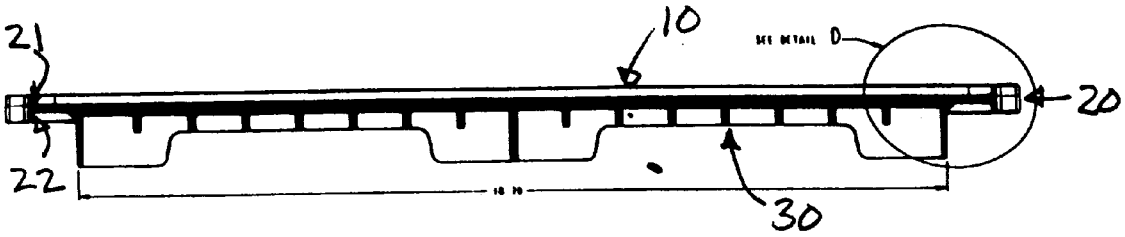
FIGS. 2A–2C are cut-away side views of an exemplary support tray according to an embodiment of the present invention.
Figure 2B:
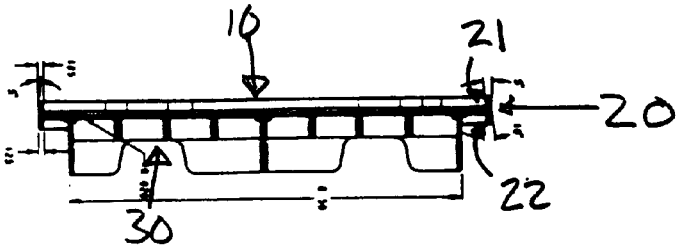
Figure 2C:
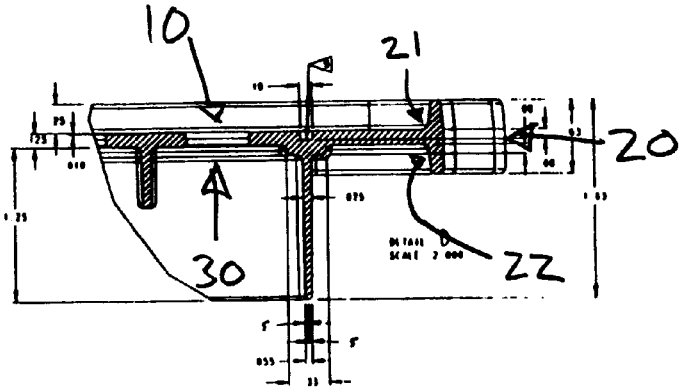

FIGS. 2A–2C are cut-away side views of the exemplary support tray 100 of FIG. 1. Support tray 100 includes side perimeter 20. The side perimeter 20 may include an upper rim 21 and a lower rim 22 for additional support and rigidity. The side perimeter 20 also may be contoured to provide for handles 23. Likewise, side perimeter 20 may include handle straps 24 for lifting of the support tray 100 out of an exemplary cooler 60. Handle straps 24 may extend from corner holes 25 near side perimeter 20.

Figure 3:
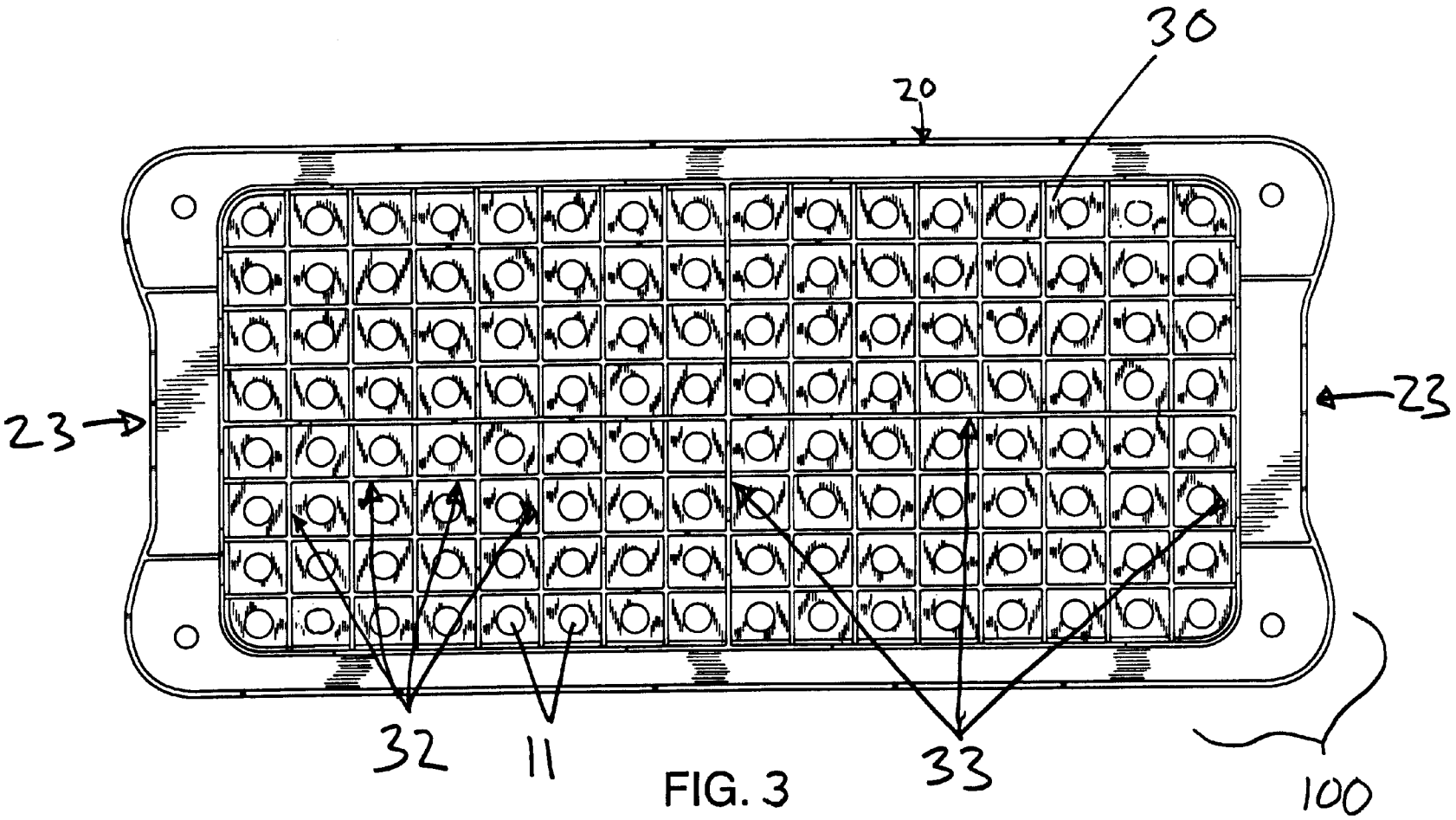
FIG. 3 is a bottom view of an exemplary support tray according to an embodiment of the present invention.
Figure 4:
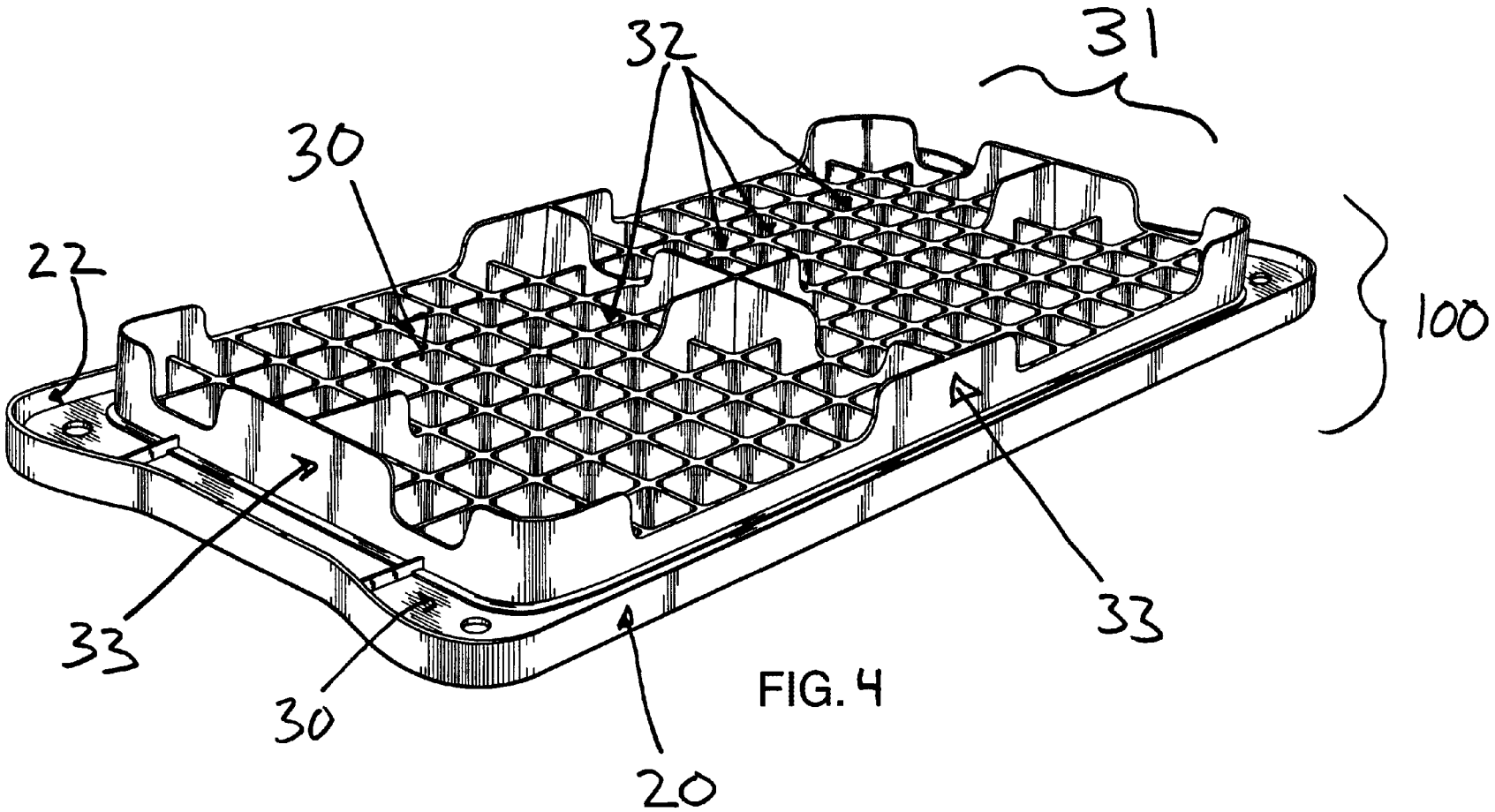
FIG. 4 is a perspective view of an underside of an exemplary support tray according an embodiment of the present 1: invention.

FIG. 3 is a bottom view of an exemplary support tray 100 according to an embodiment of the present invention. Likewise, FIG. 4 is a perspective view of an underside 30 of an exemplary support tray 100 according an embodiment of the present invention. The underside 30 may include a support grate 31. The support grate 31 may include a plurality of interconnected support beams 32 and support walls 33. The plurality of interconnected support beams 32 and support walls 33 may surround the perforations 11. Support beams 32 and support walls 33 provide rigidity and support to support tray 100 and serve to elevate underside 30 from the floor of cooler 60.

Figure 5A:
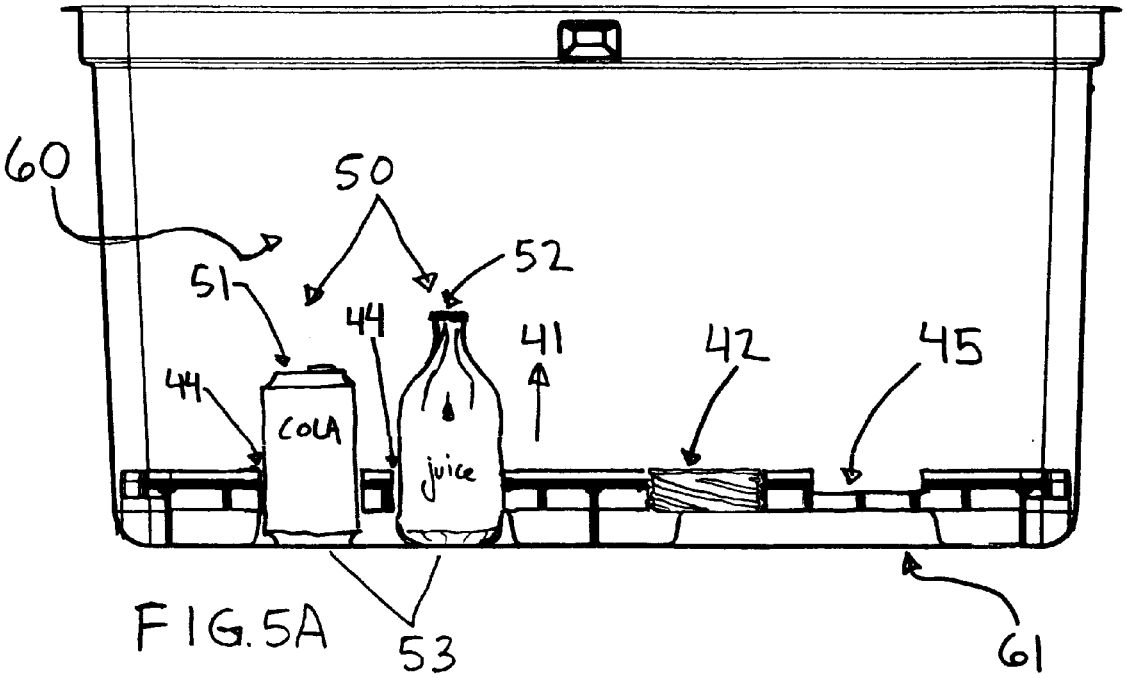
FIGS. 5A–5B are cut-away side views of an exemplary support tray including an exemplary beverage container holder resting in an exemplary cooler and storing an exemplary beverage container in an upright position according to another embodiment of the present invention.
Figure 5B:
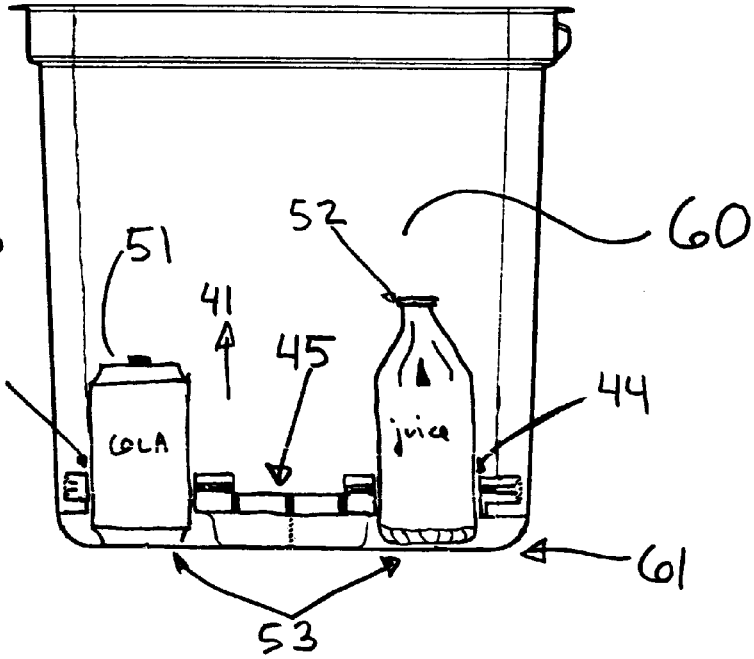

Another embodiment of the present invention may provide at least one beverage container holder 40 that stores a beverage container 50 in an upright position 41. FIGS. 5A–5B are cut-away side views of an exemplary support tray 100 including exemplary beverage container holders 40 resting in an exemplary cooler 60. Beverage container holder 40 may comprise holes 44 or slots 45. Holes 44 traverse support tray 100 and allow beverage container 50 to rest on a floor 61 of cooler 60, whereas slots 45 do not traverse support tray 100. Support tray 100 may store exemplary beverage containers 50, e.g., a can 51 and a bottle 52, in an upright position 41 according to another embodiment of the present invention. A base 53 of the beverage container 50 placed in a hole 44 may rest in the cold water pooling on floor 61 for improved thermal conduction during storage in the beverage container holder 40. The holes 44 may be sized, for example, to fit typically-sized bottles or cans that commonly may have a base diameter of about 2 inches to about 4 inches. A hole 44 with a diameter of about 2.5 inches may accommodate most single-serving cans and bottles.

A beverage container holder cap 42 may be secured to the top surface 10 around the hole 44 of the beverage container holder 40 when the beverage container holder 40 is not in use. Cap 42 may be attached by, for example, a conventional snap- or screw-style closure commonly known in the art.

Figure 6:
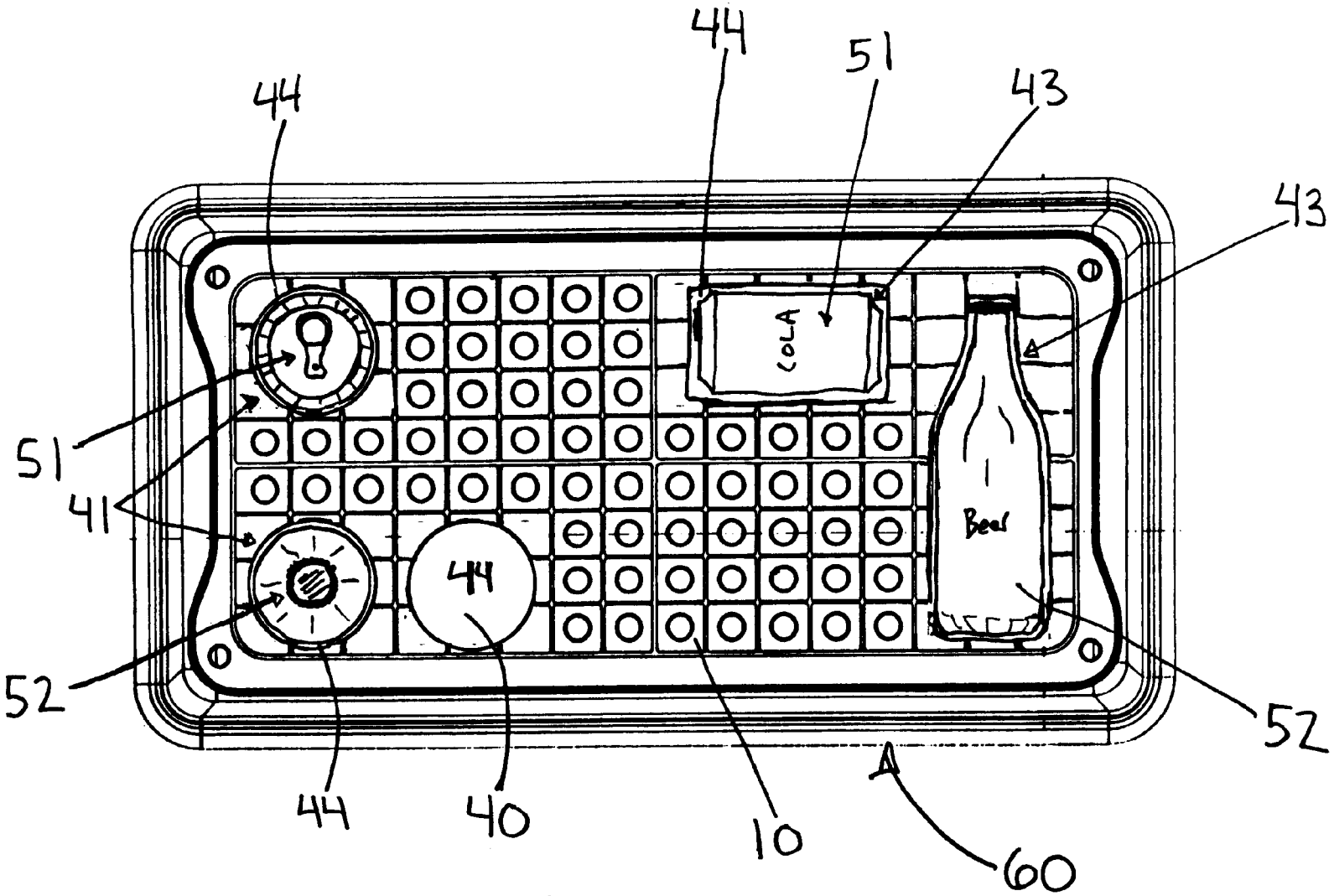
FIG. 6 is a top view of an exemplary support tray including exemplary beverage container holders resting in an exemplary cooler and storing exemplary beverage containers in upright and lateral positions according to another embodiment of the present invention.

Alternatively, a beverage container holder 40 may store a beverage container 50 in a lateral position 43. FIG. 6 is a top view of an exemplary support tray 100 including exemplary beverage container holders 40 resting in an exemplary cooler 60. Support tray 100 of FIG. 6 is shown storing exemplary beverage containers 50, e.g., a can 51 and a bottle 52, in upright 41 and lateral 43 positions according to another embodiment of the present invention.

Figures 7, 8A, 8B:
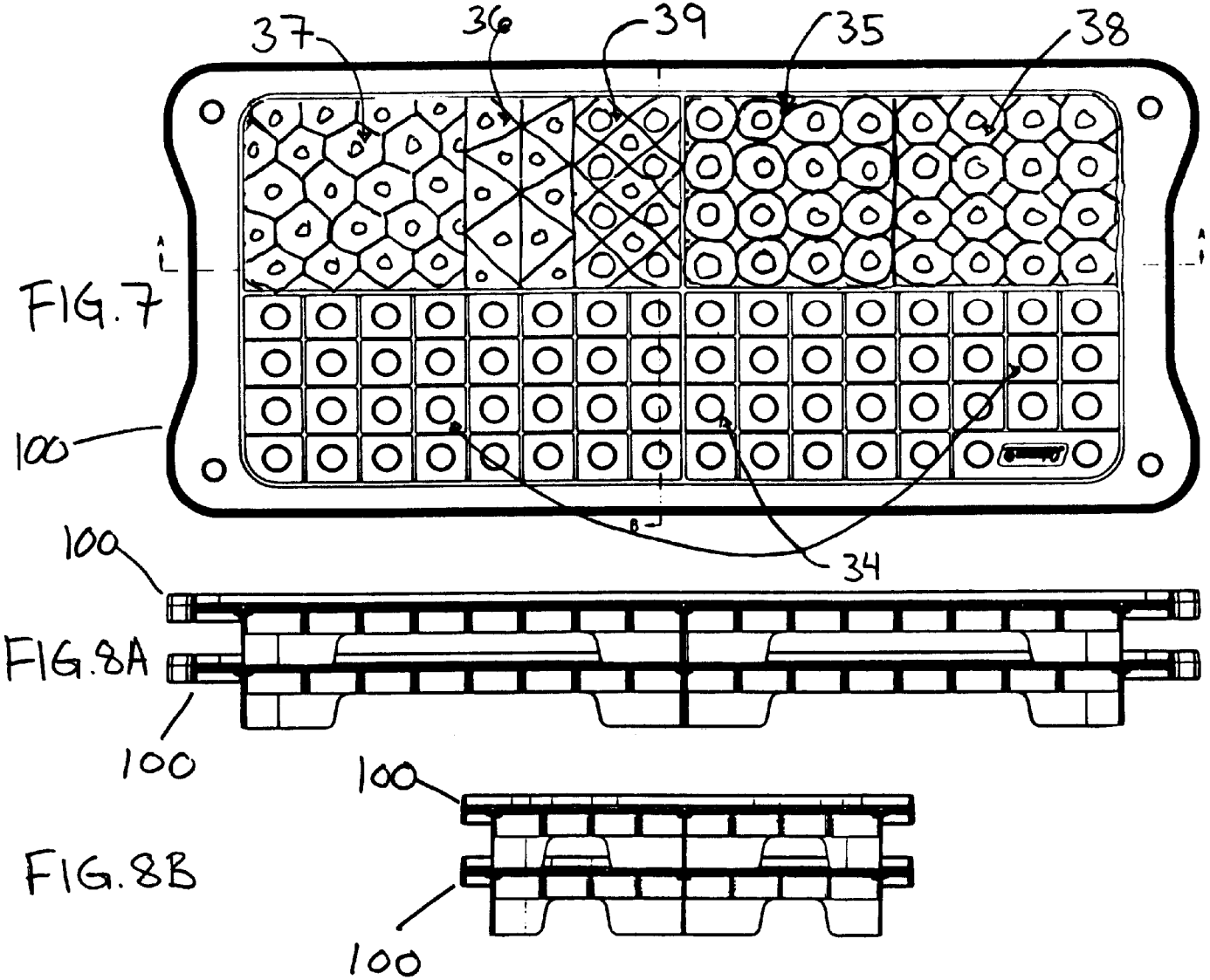
FIG. 7 is a top view of an exemplary support tray according to an embodiment of the present invention including exemplary grate patterns.
FIGS. 8A–8B are cut-away side views of exemplary support trays stacked on top of each other according to another embodiment of the present invention.

FIG. 7 is a top view of an exemplary support tray according to an embodiment of the present invention including exemplary grate patterns. As shown in FIGS. 3 and 4, the plurality of support beams 32 and support walls 33 may form a grid of rectangles 34. Alternatively, as shown in FIG. 7, the plurality of support beams 32 and support walls 33 may create any pattern of shapes, such as circles 35, triangles 36, honeycombs 37, octagons 38, or diamonds 39.

In addition to the storage of beverage containers, support tray 100 may be used as a foundation for additional cooler content management devices, which may stack on top of support tray 100 and have legs that fit within the perforations of top surface 10. Similarly, support trays 100 may stack on top of one another to provide greater elevation of top surface 10 in the event more ice is used than one support tray 100 can isolate. FIGS. 8A–8B are cut-away side views of exemplary support trays stacked on top of each other according to another embodiment of the present invention.

A number of embodiments of the present invention have been described above. Nevertheless, it will be understood that various modifications may be made without departing from the spirit and scope of the invention. Accordingly, other embodiments may be within the scope of the following claims. It is intended that all matter contained in the above description or shown in the accompanying drawings shall be interpreted as illustrative and not in a limiting sense. It is also understood that the following claims are intended to cover all of the generic and specific features of the invention herein described and all statements of the scope of the invention, expressed or implied.

What is claimed is:

1. A support tray comprising:

a top surface being substantially planar;

an underside having a support grate; and a side perimeter bounding a thickness between the top surface and the underside;

wherein the side perimeter passes within an interior cavity of a cooler so that the support grate may rest flat on an interior floor of the cooler, causing the support grate to elevate the underside from the interior floor of the cooler, permitting cooler contents placed on the top surface to avoid contacting liquids that may pool beneath the underside on the interior floor of the cooler.

2. The support tray of claim 1, wherein the top surface includes a plurality of perforations leading to the underside, so that liquid from above the top surface may pass through the plurality of perforations to pool on the interior floor of the cooler.

3. The support tray of claim 2, wherein the support grate includes a plurality of support beams interconnected to a plurality of support walls, the plurality of support beams circumnavigating the perforations.

4. The support tray of claim 1, wherein the support grate includes a plurality of support beams interconnected to a plurality of support walls, and the support grate complements the top surface to facilitate stacking at least two support trays.

5. The support tray of claim 1, wherein the side perimeter includes an upper rim and a lower rim.

6. The support tray of claim 1, wherein the side perimeter is contoured to provide for handles.

7. A support tray comprising:

a top surface being substantially planar;

an underside having a support grate; and a side perimeter bounding a thickness between the top surface and the underside;

wherein the side perimeter passes within an interior cavity of a cooler so that the support grate may rest flat on an interior floor of the cooler, causing the support grate to elevate the underside from the interior floor of the cooler, permitting cooler contents placed on the top surface to avoid contacting liquids that may pool beneath the underside on the interior floor of the cooler, wherein the side perimeter includes handle straps extending upward from the top surface.

8. The support tray of claim 1, wherein the top surface, the underside, and the side perimeter are made of a rigid plastic construction suitable for cleaning in a dishwasher.

9. A support tray comprising:

a top surface being substantially planar;

an underside having a support grate; and a side perimeter bounding a thickness between the top surface and the underside;

wherein the side perimeter passes within an interior cavity of a cooler so that the support grate may rest flat on an interior floor of the cooler, causing the support grate to elevate the underside from the interior floor of the cooler, permitting cooler contents placed on the top surface to avoid contacting liquids that may pool beneath the underside on the interior floor of the cooler, wherein the top surface includes at least one beverage container holder.

10. The support tray of claim 9, wherein the at least one beverage container holder stores a beverage container in an upright position.

11. The support tray of claim 10, wherein the at least one beverage container holder includes a hole in the top surface through which the beverage container is placed so that a base of the beverage container may rest in the liquid pooling on the interior floor of the cooler during storage in the beverage container holder.

12. The support tray of claim 11, wherein a beverage container holder cap may be placed in the hole and secured to the top surface when the at least one beverage container holder is not in use.

13. The support tray of claim 9, wherein the at least one beverage container holder may store a beverage container in a lateral position.

14. A cooler assembly comprising:

a cooler having a sidewall, a top side and a bottom side that are substantially planar and rectangular; and a support tray sized to fit closely within the cooler;

wherein cooler contents placed on the support tray do not contact liquids that may pool beneath the support tray within the cooler;

wherein the cooler comprises a closeable container having an inner surface and an outer surface, an insulating material being disposed between the inner surface and the outer surface; the closeable container including at least one chamber delimited by inner surfaces of the sidewall, the top side, and the bottom side; and the at least one chamber having an interior floor; and wherein the support tray comprises a top surface being substantially planar, an underside having a support grate, and a side perimeter bounding a thickness between the top surface and the underside, so that the support grate may rest on the interior floor of the at least one chamber, causing the support grate to elevate the underside from the interior floor of the at least one chamber.

15. The cooler assembly of claim 14, wherein the top surface includes a plurality of perforations leading to the underside so that liquid from above the top surface may pass through the plurality of perforations to pool on the interior floor of the at least one chamber.

16. The cooler assembly of claim 15, wherein the support grate includes a plurality of support walls interconnected to a plurality of support beams that surround the perforations, and the support grate complements the top surface to facilitate stacking at least two support trays.

17. The cooler assembly of claim 14, wherein the side perimeter includes an upper rim and a lower rim.

18. A cooler assembly comprising:

a cooler having a sidewall, a top side and a bottom side that are substantially planar and rectangular; and a support tray sized to fit closely within the cooler;

wherein cooler contents placed on the support tray do not contact liquids that may pool beneath the support tray within the cooler;

wherein the cooler comprises a closeable container having an inner surface and an outer surface, an insulating material being disposed between the inner surface and the outer surface; the closeable container including at least one chamber delimited by inner surfaces of the sidewall, the top side, and the bottom side; and the at least one chamber having an interior floor;

wherein the support tray comprises a top surface being substantially planar, an underside having a support grate, and a side perimeter bounding a thickness between the top surface and the underside, so that the support grate may rest on the interior floor of the at least one chamber, causing the support grate to elevate the underside from the interior floor of the at least one chamber and;

wherein the top surface includes at least one beverage container holder that stores a beverage container in an upright position.

19. The cooler assembly of claim 18, wherein the at least one beverage container holder includes a hole in the top surface through which the beverage container is placed so that a base of the beverage container may rest in the liquid pooling on the interior floor of the chamber during storage in the beverage container holder.

* * * * *